United States Patent [19]

Dollenmayer

[11] 4,319,849

[45] Mar. 16, 1982

[54] PRINT HAMMER FOR HIGH SPEED IMPACT PRINTER

[75] Inventor: William L. Dollenmayer, Versailles, Ky.

[73] Assignee: International Business Machines Corporation, Armonk, N.Y.

[21] Appl. No.: 106,613

[22] Filed: Dec. 26, 1979

[51] Int. Cl.[3] ..... B41J 1/24

[52] U.S. Cl. ..... 400/144.2; 400/144.3; 400/157.2; 101/93.48

[58] Field of Search ..... 101/93.29–93.36, 101/93.14, 93.48; 400/144.2, 144.3, 157.1, 157.2, 157.3

[56] References Cited

U.S. PATENT DOCUMENTS

| | | | |
|---|---|---|---|
| 3,574,326 | 4/1971 | Koehn | 400/144.3 |
| 3,651,915 | 3/1972 | Folkens | 400/157.1 X |
| 3,651,916 | 3/1972 | Becchi | 400/144.2 |

OTHER PUBLICATIONS

Meier, IBM Tech. Discl. Bulletin, vol. 16, No. 6, 11–73, pp. 1693–1694.

*Primary Examiner*—Edward M. Coven
*Attorney, Agent, or Firm*—John W. Girvin, Jr.

[57] ABSTRACT

A print hammer for a high speed impact printer using a movable type-face-carrier, e.g., a rotatable printwheel. The print hammer is designed to enable rotating the printwheel for character selection purposes during the return stroke of the print hammer from impact position back to its rest position. While the print hammer moves in a plane perpendicular to the printer platen, back to rest position, pivotal and cam means cooperate to lift the hook shaped hammer head up and over the printwheel, therefore continuously clearing the path of said rotatable printwheel.

9 Claims, 11 Drawing Figures

RESTORE 2

REST

RESTORE 1

IMPACT

PRINT HAMMER FOR HIGH SPEED IMPACT PRINTER

BACKGROUND OF THE INVENTION

This application relates to a print hammer for high speed printers, and more particularly, for high speed printers wherein the type-face-carrier is moved in front of the print hammer for character selection purposes.

The general requirement for high speed printers is to print as many characters in a second as possible and this means a high cyclic rate. In impact printers using movable type-face-carriers, printing is achieved by moving the type-face-carrier to present the character to be printed in front of a print position and then driving a print hammer from a rest position to an impact position wherein a character printing element borne by said type-face-carrier is struck onto a recording medium held by a platen cylinder. Prior to any start of subsequent printing, the print cycle has to be completed, i.e., the hammer has to go back to its rest position before the type-face-carrier can be moved to present the next character to be printed, in front of the next print position.

For instance, printers are known in which the type-face-carrier is made of a printwheel provided with radially extending resilient pads or fingers each of which bears a character printing element on its extremity. Proper positioning of a pad for printing purposes involves two movements, a rectilinear shifting movement of the print-wheel along the platen and a rotary movement of the printwheel to present the desired pad in front of the print hammer. The printing speed may be increased by having these two movements overlapping each other in time, i.e., the printwheel is rotated while being shifted. However, since printing is performed by having the print hammer strike a pad against the printing medium, any printwheel rotation is prohibited until the printwheel path has been cleared by the return of the print hammer. One way of reducing the time the print hammer interferes with the path of the rotatable printwheel is by positioning the printwheel as close to the platen as possible, but this reduces the printline visibility, which, from a user's standpoint is a great disadvantage.

Another way for reducing the time the print hammer prohibits the printwheel from being rotated while said print hammer is in print position, is by articulating the hammer head. Such a hammer has been disclosed in the U.S. Pat. No. 3,651,916 assigned to Ing. C. Olivetti by Raffaele Becchi. Becchi's hammer is provided with head articulated for being movable in a horizontal plane. With such an implementation, the printwheel can be positioned a little further away from the platen since rotation of said printwheel is not completely prohibited by the hammer returning to its rest position. This supposes, however, that the printwheel is to be rotated in one direction only. In addition, the printwheel cannot be positioned too far away from the platen otherwise interference between the hammer head returning to its rest position and the printwheel path might be too long in time, which means that several fingers might hit the hammer head while the printwheel is being rotated, which could result in printwheel damaging, unless the printing speed is being reduced.

SUMMARY OF THE INVENTION

One object of the present invention is to provide a print hammer structure which enables increasing printline visibility in a high speed impact printer.

This object is achieved by positioning the printwheel and hammer further away from the platen. The widened gap between the printwheel and platen necessitates a longer stroke hammer than employed in prior art printers with narrower printwheel-to-platen gaps.

Another object is to assure that the cycle time of this longer stroke hammer does not consume a prohibitive amount of the total print cycle time.

Accordingly, the print hammer has been designed to lift up and over the printwheel so as to clear the space scanned by the printwheel (i.e., printwheel path) while said print hammer is on its way back from its impact position to its rest position. This printwheel path is cleared right after impact is performed, and rotation of the printwheel for proper positioning of the finger bearing the next character to be printed can be started while the print hammer is traveling back to its rest position.

BRIEF DESCRIPTION OF THE DRAWINGS

The invention will be more clearly understood with reference to the accompanying description taken in conjunction with the following drawing in which:

FIGS. 4A, 4B, 4C and 4D respectively correspond to FIGS. 2A, 2B, 2C and 2E as viewed from the opposite side of the print hammer.

DETAILED DESCRIPTION OF THE PREFERRED EMBODIMENT

Figure 1:
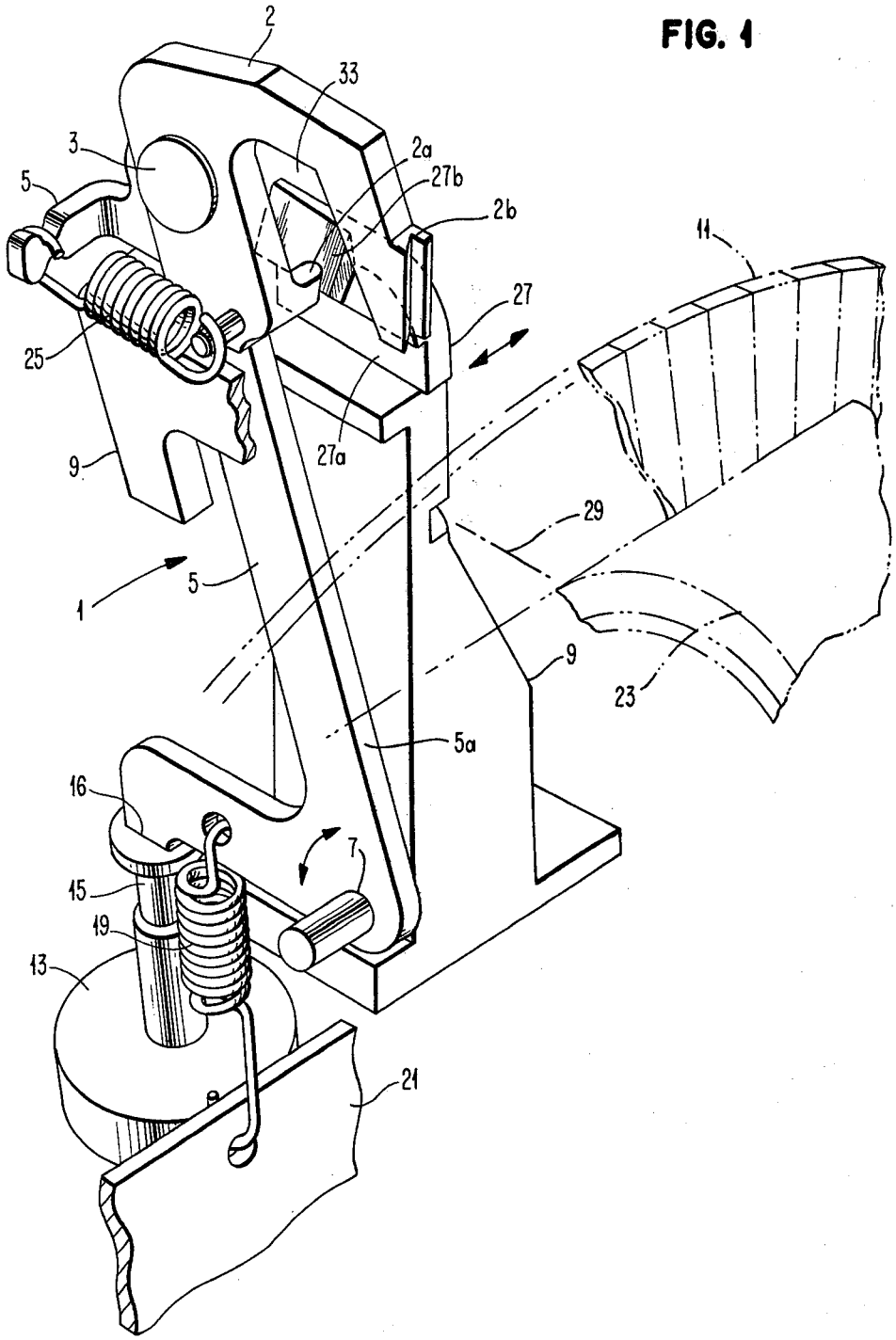
FIG. 1 illustrates a perspective view of the print hammer.

With reference to FIG. 1, a perspective view of the print hammer 1 of this invention is represented. The hammer head 2 which is hook shaped is also articulated by being pivotally attached at 3 to a power arm 5. The power arm 5, in turn, is also pivotally attached at 7 to a frame 9 which is attached to the printhead carriage (not shown) carrying, in addition to the print hammer 1, the printwheel 11, the ribbon cartridge (not shown) and the driving facilities (not shown) for both printwheel 11 and ribbon in said ribbon cartridge. The hammer power arm 5 is driven by a plunger-type solenoid 13, the plunger 15 of which pushes the power arm 5 at surface 16 to make it rotate about its pivot 7 and make the hammer head 2 strike the printwheel 11. The hammer power arm 5 is restored by restore spring 19, the lower end of which is attached to the support 21 of the frame 9. Plunger type solenoid 13 and restore spring 19 constitute drive means for reciprocatably moving the power arm 5 in a plane normal to the surface of the platen cylinder 23.

Figure 2A:
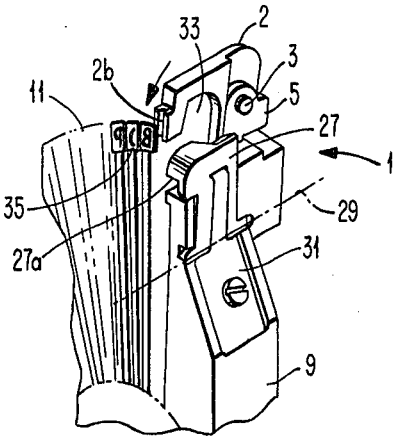
FIGS. 2A through 2E illustrate the different phases of a print cycle.

The movement of hammer head 2 about pivot 3 is biased by a return spring 25 connected between power arm 5 and the hammer head 2. The hammer head 2 angular motion relative to the power arm 5 is controlled by a cam follower 2*a* that engages a 3-dimensional cam 27 that is pivotally attached to the frame 9. The cam 27 pivots about an axis 29 that is parallel to the plane of the power arm 5 motion. The finger 2*a* also serves as a downstop for the hammer head 2 relative to the power arm 5 by encountering the front edge 5*a* of the power arm 5. The cam 27 is restored, i.e., pushed toward the hammer head 2, by a thin leaf spring 31 (see FIG. 2A) that pushes against the side of cam 27. FIG. 2A is a view of the print hammer 1 of this invention from the opposite side to that shown in FIG. 1.

Figure 2B:
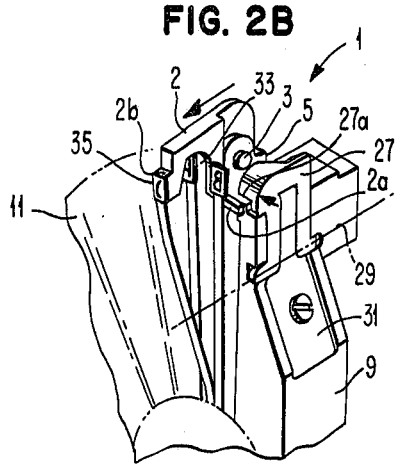
Figure 2C:
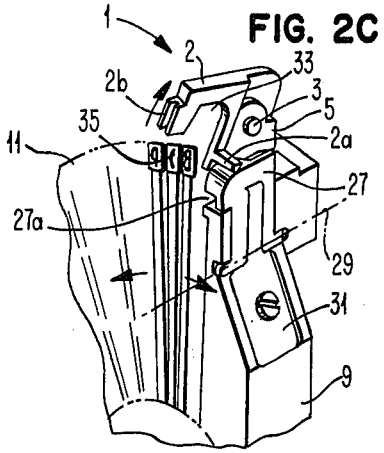

The print hammer 1 positions relative to the printwheel 11 can be seen in FIGS. 2A to 2E showing various phases of the print hammer 1 operation to be described later on. Note that the cut-out portion 33 in the hook-shaped hammer head 2 allows the hammer head 2 to pass "through" the plane of the printwheel 11 and not be interfering with that plane while being in the impact position as shown in FIG. 2B. This cut-out 33 combined with the lift up and over action provided to the hammer head 2 enables clearance of the printwheel 11 path as soon as the character impacting operation shown on FIG. 2B is performed. In other words, the hook shape of the hammer head 2 enables clearance of the printwheel 11 path while the printhammer 1 is in its impact position (FIG. 2B); then the cam 27 cooperating with the articulation means comprising essentially the pivot 3 and return spring 25, lifts the hammer head 2 up and over the path of the printwheel 11 (as shown on FIGS. 2C, 2D, 3, 4C and 4D described further on). Rotation of the printwheel 11 for selection of the next character to be printed may thus start as soon as the pad 35 bearing the character just printed has been moved out of contact with the recording medium (not shown), and said rotation may continue while the print hammer 1 is being moved back to its rest position.

Figure 4D:
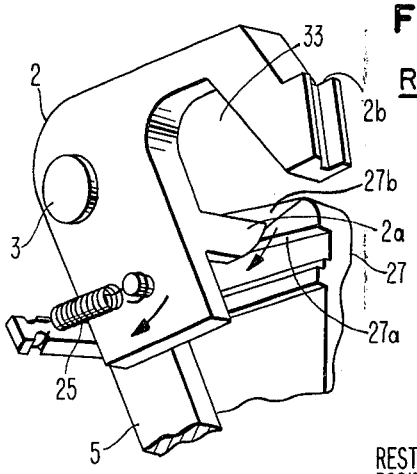
FIGS. 4A through 4D are detailed representations of the different positions of the hammer head during a print cycle.
Figure 4A:
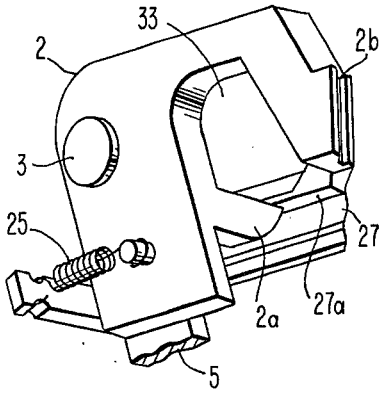
Figure 3:
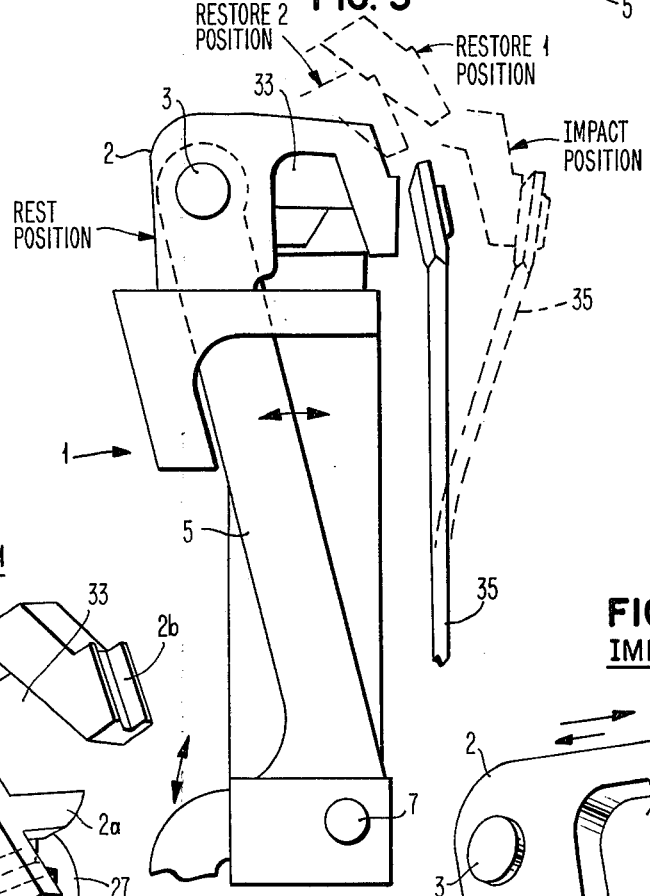
FIG. 3 is a side view showing the different positions of the print hammer during a print cycle.
Figure 4C:
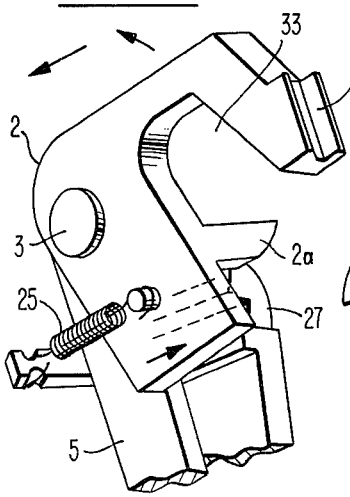
Figure 4B:
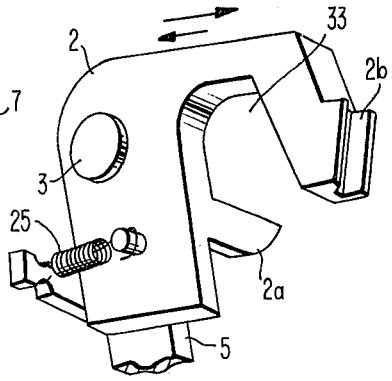

FIGS. 2A and 4A show the hammer head 2 in the rest position, also represented in FIG. 3. When the solenoid 13 (see FIG. 1) is energized, it begins to move the hammer head 2 toward the platen cylinder 23 (see FIG. 1) in a plane perpendicular to the axis of said cylinder 22. The cam 27 is designed such that the cam follower 2*a* is held under a ledge 27*a* on the forward or impact stroke (see FIG. 4A). This prevents the centrifugal forces on the hammer head 2 from causing it to rotate upward. An action such as the latter would cause a machine failure by allowing the hammer head 2 to go over the printwheel 11 and strike the platen cylinder 23, possibly ripping the ribbon (not shown).

Figure 2E:
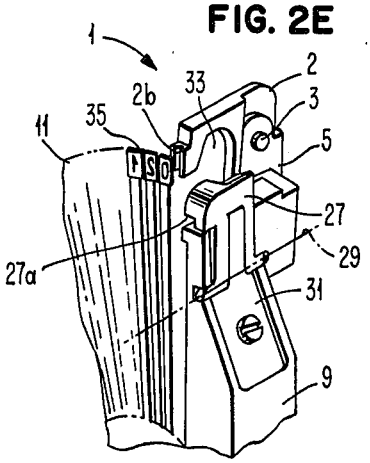
Figure 2D:
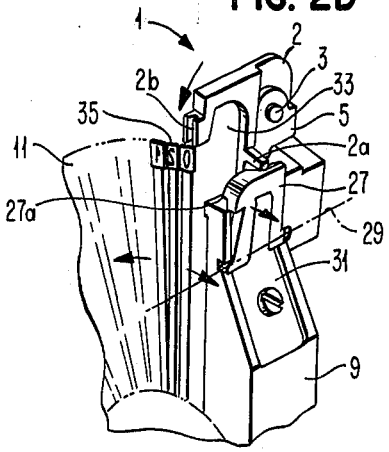

As shown in FIGS. 2A and 2E, the cam follower 2*a* during this part of the cycle, from rest position to impact position of the printhammer 1 as well as in rest position, is holding the cam 27 and a resilient member, i.e., leaf spring 31 in their open position (closed denoting position of the leaf spring 31 and cam 27 closest to the frame 9). Further, along in the same stroke with the hammer head 2 moving toward impact position, the cam follower 2*a* passes the front edge of the cam 27 and the cam lead spring 31 begins to force the cam 27 into the closed position (see FIG. 2B). This event may occur less than a millimeter from the impact position. Until impact occurs, the hammer head 2 remains stationary to the power arm 5. It should be noted that the motion power developed to move the print hammer 1 from rest position toward impact position is provided by energizing the solenoid 13, of FIG. 1, but the power to the solenoid should be turned off before impact occurs. Impact occurs very quickly, on the order of 100 to 200 microseconds. From the time the cam follower 2*a* has passed the cam 27 to the end of the impact time, the cam leaf spring 31 has forced the cam 27 into the closed position, setting the stage for print hammer 1 return. It should also be noted on FIG. 2B how the path of the idle pads of the printwheel 11 is kept cleared by the cut out 33 into the hook shaped hammer head 2, while the pad 35 is still bent.

With reference to FIG. 1, the return stroke of the hammer head 2 from impact position to rest position is more elaborate than the impact stroke because of the lifting up and over action. Like in any other hammer, a momentum transfer occurs at the platen cylinder 23; in this case, sending the hammer head 2 and power arm 5 away from the platen. Since the plunger 15 of solenoid 13 is in contact with the power arm 5 at surface 16, the plunger 15 begins to return also to its rest position. The restore spring 19 serves to make the return stroke reliable and controlled.

Upon departure from the platen cylinder 23 the path of the hammer head 2 is blocked by the cam 27. The cam follower 2*a* strikes the leading edge of the cam 27 and the hammer head 2 begins to rotate about the hammer head pivot 3 (see FIGS. 2C and 4C). The resultant path of the hammer head 2 up and over the printwheel 11 pads is quite accurate and controlled. It never interferes with the printwheel 11, even with the printwheel 11 rotating. In other words, during the return stroke of the print hammer 1, the hammer head 2 alters its path of travel while traveling back from impact position to rest position, to lift up and over the printwheel 11 and therefore clear the space scanned by the printwheel 11 while rotating. Character selection operation, i.e., rotation of the printwheel 11 can thus commence as the cam follower 2*a* strikes the cam 27. The printwheel pad 35 bearing the character which was just printed will slide off of the detent section 2*b* (see FIG. 1) of the hammer head 2. The selection operation for the next character to be printed may thus be started before the hammer head 2 has restored to its rest position.

At the top of the cam 27, the cam follower 2*a* has oriented the hammer head 2 above the printwheel 11. The last part of the return stroke is concerned with positioning the hammer head 2, power arm 5 and cam 27 back into their rest positions. This is accomplished by the continued action of restore spring 19 to restore the power arm 5 and solenoid plunger 15. Simultaneously, the return spring 25 urges the hammer head 2 to try and rotate to its rest position. The motion of the hammer head 2 is resisted by the cam 27 and leaf spring 31. However, as the power arm 5 reaches the end of its stroke, the cam follower 2*a* begins to slide down the transverse slope 27*b* of the cam 27. As the cam follower 2*a* continues down the slope 27*b*, it pushes the cam 27 into the open position (see FIGS. 2D and 4D). The last fraction of the hammer head 2 rotation allows the cam follower 2*a* to drop below the ledge 27*a* of the cam 27. This completes the print hammer 1 cycle.

An alternate method to return spring 25 is to use a knock-down tab that pushes the hammer head 2 down. This is accomplished by having a section (not shown) on the top of the hammer head 2 strike a tab (not shown) in the power frame 9. The motion of the power arm 5 causes the hammer head 2 to rotate down and push the cam 27 to the open position.

In both cases, the return spring 25 forces the solenoid plunger 15 to return with the power arm 5. The cycle is completed when the print hammer 1 is back into its rest position as shown in FIGS. 2E and 3, and another print hammer cycle can begin. The path of the hammer head 2 on its way back from impact position to rest position is represented in FIG. 3 with two restore positions shown to better illustrate the movement of hammer head 2. The upper portion of the hammer head 2 has been enlarged on FIGS. 4A–4D to show the cooperation of detailed elements while the print hammer 1 is in each of the four positions mentioned in FIG. 3.

While the invention has been described as applied to a printwheel printer, it may also be applied to any type of printer in which the type-face-carrier is moved in a gap located between print hammer and platen for character selection purposes, e.g., printers using cup shaped type-face-carriers or chains.

What is claimed is:

1. In an impact printer wherein a character print cycle involves moving a print hammer from a rest position to an impact position in which a selected character printing element borne by a movable type-face-carrier having plural character printing elements is struck by the print hammer onto a recording medium held by a platen and then subsequently moving said print hammer back to said rest position while the non-selected character printing elements of said type-face-carrier are moved through a scanning path for positioning the next selected character printing element, said print hammer comprising:

a frame;

a power arm mounted on said frame and movable toward and from the surface of the platen;

a heammer head;

pivot means connecting said hammer head to said power arm;

driver means for reciprocatably moving said power arm and for moving said hammer head to enter through said scanning path to engage said selected character printing element as said hammer head travels toward said platen; and, a cam means attached to said frame for causing said hammer head to pivot about said pivot means relative to said power arm for inhibiting the hammer head from re-entering the scanning path of the non-selected character printing elements while said print hammer is traveling back from said impact position to said rest position whereby said hammer head does not contact the moving non-selected character printing elements as said print hammer returns to said rest position.

2. In an impact printer according to claim 1, the print hammer being further characterized in that said power arm is pivotally mounted on said frame.

3. In an impact printer according to claim 1, the print hammer being further characterized in that said hammer head is hook shaped to clear the scanning path of the non-selected character printing elements while the hammer head is in the impact position.

4. In an impact printer according to claim 1, a print hammer in which said pivot means connecting said hammer head to said power arm includes a return spring for biasing said hammer head against said power arm.

5. In an impact printer according to claim 4, the print hammer in which said cam means causes said hammer head to pivot against the bias of said spring.

6. In an impact printer according to claim 4, the print hammer in which said cam means includes:

a cam follower attached to said hammer head;

a cam pivotally mounted on the frame for pivoting with respect to said hammer head for presenting a first cam profile to said cam follower as said print hammer moves toward said platen and for presenting a second cam profile to said cam follower as said print hammer moves toward said rest position;

resilient means for biasing said cam toward the hammer head.

7. In an impact printer according to claim 6, the print hammer in which said cam pivotally mounted on the frame is provided with said first cam profile on which said cam follower travels while the print hammer is being moved from its rest position toward its impact position for guiding said hammer head toward said scanning path to strike and carry said selected character printing element toward said impact position.

8. In an impact printer according to claim 7, the print hammer in which said second cam profile is shaped to provide rotation of the hammer head relative to the power arm about said pivot means, whereby said hammer head is lifted from the scanning path on the return stroke of the print hammer back to its rest position.

9. An impact printer according to claim 8 in which said movable type-face-carrier is a printwheel.

* * * * *